US010086973B2

(12) United States Patent
Nussbaum et al.

(10) Patent No.: US 10,086,973 B2
(45) Date of Patent: Oct. 2, 2018

(54) PALLET AND DOLLY WITH BAIL ARM

(71) Applicant: ORBIS Corporation, Oconomowoc, WI (US)

(72) Inventors: Robert Guy Nussbaum, Oconomowoc, WI (US); Stephen Roland Howe, Cottage Grove, WI (US)

(73) Assignee: ORBIS Corporation, Oconomowoc, WI (US)

( * ) Notice: Subject to any disclaimer, the term of this patent is extended or adjusted under 35 U.S.C. 154(b) by 0 days.

(21) Appl. No.: 15/390,015

(22) Filed: Dec. 23, 2016

(65) Prior Publication Data

US 2017/0190465 A1 Jul. 6, 2017

Related U.S. Application Data

(60) Provisional application No. 62/272,852, filed on Dec. 30, 2015.

(51) Int. Cl.

| | |
|---|---|
| ***B65D 19/44*** | (2006.01) |
| ***B65D 19/38*** | (2006.01) |
| ***B65D 19/00*** | (2006.01) |
| ***B65D 19/42*** | (2006.01) |

(52) U.S. Cl.

CPC ..... *B65D 19/385* (2013.01); *B65D 19/0008* (2013.01); *B65D 19/42* (2013.01); *B65D 2519/00273* (2013.01); *B65D 2519/00288* (2013.01); *B65D 2519/00781* (2013.01); *B65D 2519/00865* (2013.01)

(58) Field of Classification Search

CPC ..... B65D 19/44

USPC ..... 108/51.11, 55.1, 55.3

See application file for complete search history.

(56) References Cited

U.S. PATENT DOCUMENTS

| | | | |
|---|---|---|---|
| 3,073,274 | A | 1/1963 | Lamb |
| 3,420,379 | A | 1/1969 | Berryman |
| 3,511,191 | A | 5/1970 | Barry, Jr. et al. |
| 3,581,681 | A | 6/1971 | Newton |
| 3,610,720 | A | 10/1971 | Hosmer |
| 3,661,099 | A | 5/1972 | Shelor |
| 3,685,461 | A | 8/1972 | Belcher |
| 3,689,098 | A | 9/1972 | Rubin |

(Continued)

FOREIGN PATENT DOCUMENTS

| | | |
|---|---|---|
| CA | ID-99478 | 4/2003 |
| CA | 2757947 A1 | 5/2012 |

(Continued)

OTHER PUBLICATIONS

DS Smith Companies; "Dura-Ply Pallets" circular; date unknown (1 page).

(Continued)

*Primary Examiner* — Matthew W Ing

(74) *Attorney, Agent, or Firm* — Joseph A. Fuchs; Greensfelder, Hemker & Gale, P.C.

(57) ABSTRACT

A pallet having a deck with a generally planar upper surface with a peripheral edge defining a first area, and a ground engaging structure connected to the deck is provided. A mechanism is connected to the pallet and is moveable from a stowed position to a deployed position. When in the deployed position, a portion of the mechanism defines an overhang area adjacent the first area to increase a total support area of the pallet.

23 Claims, 3 Drawing Sheets

(56) References Cited

U.S. PATENT DOCUMENTS

| | | | |
|---|---|---|---|
| 3,707,929 | A | 1/1973 | Lauffer |
| 3,719,157 | A | 3/1973 | Arcocha et al. |
| 3,720,176 | A | 3/1973 | Munroe |
| 3,757,704 | A | 9/1973 | Allgeyer et al. |
| 3,814,778 | A | 6/1974 | Hashimoto et al. |
| 3,846,348 | A | 11/1974 | Horst |
| 4,159,681 | A | 7/1979 | Vandament |
| 4,230,049 | A | 10/1980 | Horne |
| 4,241,555 | A | 12/1980 | Dickens et al. |
| 4,329,231 | A | 5/1982 | Hoffman et al. |
| 4,440,708 | A | 4/1984 | Haataja et al. |
| 4,467,728 | A | 8/1984 | Horne |
| 4,742,781 | A | 5/1988 | Shuert |
| 4,822,066 | A | 4/1989 | Rehrig |
| 4,824,129 | A | 4/1989 | Rehrig |
| 4,972,611 | A | 11/1990 | Swartz et al. |
| 5,069,358 | A | 12/1991 | Avery, Jr. |
| 5,329,862 | A | 7/1994 | Breezer et al. |
| 5,349,749 | A | 9/1994 | Fiedler |
| 5,401,456 | A | 3/1995 | Alesi, Jr. et al. |
| 5,413,052 | A | 5/1995 | Breezer et al. |
| 5,528,994 | A | 6/1996 | Iseli |
| 5,556,118 | A | 9/1996 | Kern et al. |
| 5,590,606 | A | 1/1997 | Crews et al. |
| 5,592,885 | A | 1/1997 | Young, Jr. et al. |
| 5,636,577 | A | 6/1997 | Gow |
| 5,687,652 | A | 11/1997 | Ruma |
| 5,706,738 | A | 1/1998 | Pekka |
| 5,829,595 | A | 11/1998 | Brown et al. |
| 5,832,841 | A | 11/1998 | Crews et al. |
| 5,833,207 | A | 11/1998 | Hagenhoff et al. |
| 5,875,904 | A | 3/1999 | Vorstenbosch |
| 5,921,566 | A | 7/1999 | Kern et al. |
| 6,012,587 | A | 1/2000 | McCullough |
| 6,206,385 | B1 | 3/2001 | Kern et al. |
| 6,209,464 | B1 | 4/2001 | Elder |
| 6,257,152 | B1 | 7/2001 | Ching-Rong |
| 6,305,301 | B1 | 10/2001 | Piper, Jr. et al. |
| 6,345,828 | B1 | 2/2002 | Pool et al. |
| 6,357,366 | B1 | 3/2002 | Frankenberg |
| D459,049 | S | 6/2002 | Apps et al. |
| 6,420,459 | B1 | 7/2002 | Horold |
| D472,028 | S | 3/2003 | Stahl |
| 6,659,020 | B1 | 12/2003 | Ball |
| 6,675,723 | B2 | 1/2004 | Sukeva |
| 6,718,888 | B2 | 4/2004 | Muirhead |
| 6,748,876 | B2 | 6/2004 | Preisler et al. |
| 6,758,148 | B2 | 7/2004 | Torrey et al. |
| 6,886,787 | B2 | 5/2005 | Stahl |
| 6,928,933 | B2 | 8/2005 | Grau |
| 6,971,518 | B1 | 12/2005 | Lowry |
| 6,974,140 | B2 | 12/2005 | Neuman |
| 6,998,433 | B2 | 2/2006 | Overholt et al. |
| 7,036,833 | B1 | 5/2006 | Berna et al. |
| 7,044,065 | B2 | 5/2006 | Arai et al. |
| 7,059,617 | B1 | 6/2006 | Verna |
| 7,066,477 | B2 | 6/2006 | Dubois et al. |
| 7,219,905 | B1 | 5/2007 | Wilson |
| 7,413,698 | B2 | 8/2008 | Bearse et al. |
| 7,419,457 | B1 | 9/2008 | Sudeith et al. |
| 7,874,256 | B2 | 1/2011 | Muirhead |
| 7,914,018 | B1 | 3/2011 | Rezler |
| 8,141,500 | B2 | 3/2012 | Naidu et al. |
| 8,181,580 | B2 | 5/2012 | Roth et al. |
| 8,215,244 | B2 | 7/2012 | Apps |
| 8,261,673 | B2 | 9/2012 | Ingham |
| 8,418,632 | B2 | 4/2013 | Linares |
| 8,544,648 | B2 | 10/2013 | Cleveland et al. |
| 8,567,324 | B1 | 10/2013 | Paradis et al. |
| 9,102,437 | B2 | 8/2015 | Frankenberg |
| 9,327,873 | B2 | 5/2016 | Frankenberg |
| 9,522,760 | B2 | 12/2016 | Frankenberg |
| 2001/0005070 | A1 | 6/2001 | Kemnitzer |
| 2002/0195027 | A1* | 12/2002 | Mallan ..... B65D 19/44 108/55.3 |
| 2004/0168618 | A1 | 9/2004 | Muirhead |
| 2005/0006861 | A1* | 1/2005 | Dubois ..... B62B 3/04 280/33.998 |
| 2005/0103237 | A1 | 5/2005 | Moore et al. |
| 2006/0011108 | A1 | 1/2006 | Abu-Isa et al. |
| 2007/0059119 | A1 | 3/2007 | Hadar |
| 2008/0149111 | A1 | 6/2008 | Harrison et al. |
| 2009/0085315 | A1 | 4/2009 | Meers et al. |
| 2009/0116925 | A1 | 5/2009 | Juchniewicz et al. |
| 2012/0111238 | A1 | 5/2012 | Frankenberg |
| 2013/0248674 | A1 | 9/2013 | Johnson et al. |
| 2014/0231429 | A1 | 8/2014 | Frankenberg |
| 2014/0319302 | A1 | 10/2014 | Baltz |
| 2016/0207558 | A1 | 7/2016 | Frankenberg |

FOREIGN PATENT DOCUMENTS

| | | | |
|---|---|---|---|
| DE | 3825219 | | 2/1990 |
| EP | 0807563 | A2 | 11/1997 |
| EP | 1277663 | A2 | 2/2003 |
| EP | 1306312 | A1 | 5/2003 |
| EP | 2465784 | | 6/2012 |
| FR | 1596011 | | 7/1970 |
| GB | 2280166 | A | 1/1995 |
| GB | 2359061 | A | 8/2001 |
| GB | 2377689 | A | 1/2003 |
| WO | 9316927 | A1 | 9/1993 |
| WO | 03035495 | A1 | 5/2003 |
| WO | 2006071920 | A2 | 7/2006 |

OTHER PUBLICATIONS

European Patent Office, Partial European Search Report for EP 2465784 dated May 25, 2012 (9 pages).

European Patent Office, Extended European Search Report for EP 11188320.3 dated Oct. 17, 2012 (15 pages).

International Search Report and Written Opinion of International Searching Authority for PCT/CA2011/001230 dated Feb. 13, 2012 (5 pages).

International Preliminary Report on Patentability for PCT/CA2011/001230 dated May 7, 2013 (1 page).

European Search Report for EP 02019552 dated Jan. 28, 2003 (4 pages).

Wiggins Plastics, Inc.; "Thermosets: Engineering Plastics for Demanding Applications"; retrieved from <http://www.jobshop.com/techinfo/papers/plasticstermpoly.shtml> by Examiner on Oct. 31, 2014 (3 pages).

Mexican Patent Office, First Office Action in MX/a/2011/011870 dated Mar. 2, 2015 (2 pages).

Holden Plastics Corporation; "Thermosets: Engineering Plastics for Demanding Applications"; retrieved from <http://web.archive.org/web/20060315191104/http://ww.jobshop.com/techinfo/papers/plasticstermpoly.shtml> on Oct. 22, 2014 (3 pages).

Russian Patent Office, International Search Report and Written Opinion of International Searching Authority for PCT/US2016/000098 dated Feb. 27, 2017 (7 pages).

Russian Patent Office, International Search Report and Written Opinion of International Searching Authority for PCT/US2016/068657 dated May 4, 2017 (6 pages).

* cited by examiner

PALLET AND DOLLY WITH BAIL ARM

CROSS-REFERENCE TO RELATED APPLICATIONS

The present invention claims the benefit of U.S. Provisional Patent Application No. 62/272,852 filed Dec. 30, 2015, the contents of which are incorporated herein by reference.

FIELD OF THE INVENTION

A pallet or a dolly with a deployable bail arm for accommodating loads with an area greater than the original footprint of the pallet or dolly.

BACKGROUND OF THE INVENTION

Pallets and dollies are in extensive use worldwide to facilitate the movement of goods. Both pallets and dollies may be described as low to the ground, portable platforms on which goods may be stacked for storage or moving. The two devices are distinguished primarily by their type of undersurface or ground contact. Pallets have a fixed, non-rolling, bottom surface, whereas dollies have wheels, with or without brakes.

A common type of pallet bottom surface is a skid, which is a continuous plank that provides support along its whole length. Pallets generally also include open ends configured to receive the forks of a manual pallet jack, motorized forklift truck, or other lifting device, so that the palletized load can be raised and moved about easily.

Pallets are particularly suitable for storing goods, such as in a racking arrangement, at a warehouse, moving goods on conveyor belts and roll conveyors, and for transporting goods between distant locations, where the pallets are loaded onto shipping containers, trucks, railway cars, and other vehicles. Dollies are better suited for the internal movement of goods within a given location where pallet moving equipment such as manual pallet jacks or forklift trucks would be unwieldy or costly. For example, unloading a shipment of goods at a supermarket is often more efficiently accomplished by having a stocking clerk wheel a dolly holding the goods to the appropriate display section of the store, rather than through use of a forklift.

One drawback to existing pallets and dollies is that they have a fixed planar surface area, or footprint, to accommodate loads of varying sizes. In some instances, the load area exceeds the footprint of the dolly and the load is subject to tipping or falling from the dolly. The present invention provides a mechanism connected to the dolly that can be moved from a stowed position, where the pallet has a first support area, to a deployed position where the total pallet support area is the sum of the first support area and an overhang area defined by a supplemental support surface adjacent the deck and created by the mechanism.

SUMMARY OF THE INVENTION

The present invention provides a pallet or dolly having a deck with a generally planar upper surface with a peripheral edge defining a first area, and a ground engaging structure connected to the deck. A mechanism is connected to the pallet and is moveable from a stowed position to a deployed position. When in the deployed position, a portion of the mechanism defines an overhang area adjacent the first area to increase a total support area of the pallet.

Other features and advantages of the invention will be apparent from the following specification taken in conjunction with the following Figures.

BRIEF DESCRIPTION OF THE DRAWINGS

To understand the present invention, it will now be described by way of example, with reference to the accompanying Figures in which.

DETAILED DESCRIPTION

Figure 1:
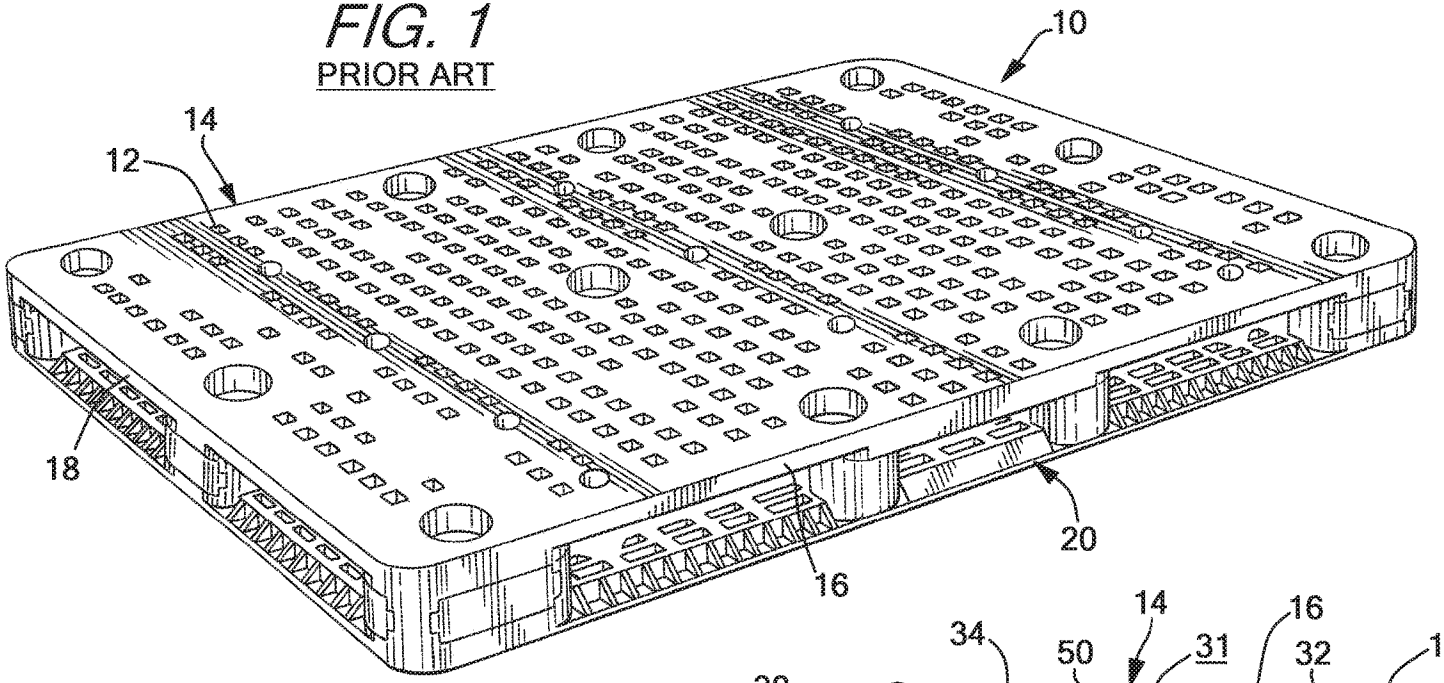
FIG. 1 PRIOR ART
FIG. 1 is a perspective top view of a prior art plastic pallet.

While this invention is susceptible of embodiment in many different forms, there is shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 shows a prior art pallet 10 having a deck 12, a peripheral edge 14 encompassing or defining a footprint, or an area. Pallets often have a distinct ground engaging structure such as a fixed, non-rolling, bottom surface including, for example, a plurality of feet extending from a lower surface 20. When pallets have a wheel or a plurality of wheels as ground engaging means, the assembly is often referred to as a dolly, a pallet dolly or a trolley.

The peripheral edge 14 is shown having two opposed lateral edges 16 and two opposed end edges 18. The area of the deck 12 is calculated by multiplying a "length" dimension of a lateral edge 16 with a "width" dimension of an end edge 18. The deck 12 is for supporting bins, boxes or other items and has a fixed support area. If a load is too large to be accommodated by the prior art pallet 10, a user of the pallet would have to seek out a pallet having a larger support area.

Figure 2:
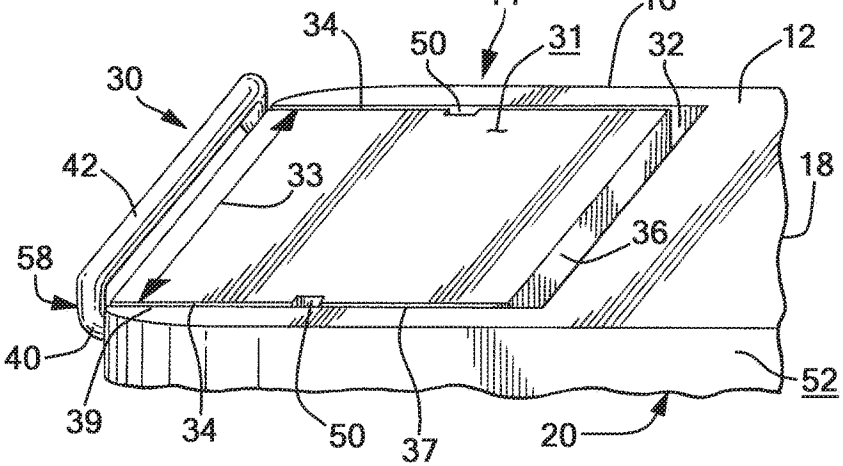
FIG. 2 is an isometric top view of a dolly or pallet with a bail arm in an extended position.
Figure 3:
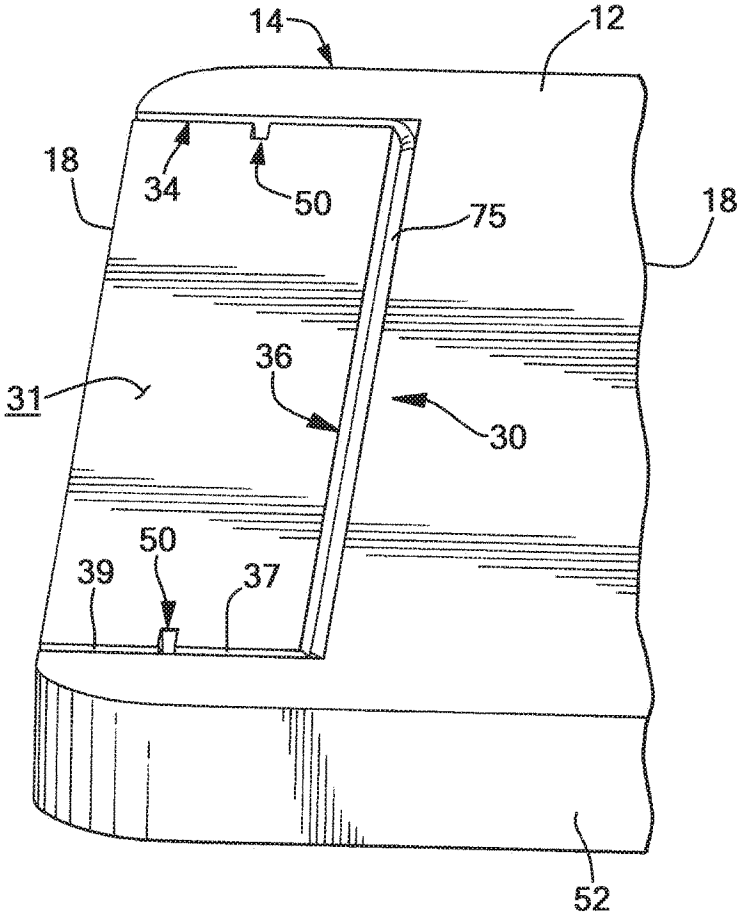
FIG. 3 is an isometric top view of the dolly or pallet of FIG. 2 with the bail arm in a stowed position.

The present invention provides a mechanism 30 connected to a pallet 10 for increasing the load supporting area of the pallet. Using the same reference numbers of FIG. 1, FIGS. 2 and 3 show a mechanism 30 connected to the pallet 10 that is moveable from a stowed position (FIG. 3) to a deployed position (FIG. 2). When in the stowed position the pallet has a first support area as defined above. When in the deployed position, the mechanism 30 forms a supplemental support surface defining an overhang area adjacent the first area. The total support area is the sum of the first support area+the overhang area.

In one form of the invention, the mechanism 30 is a bail arm assembly 30 that is moveable from the deployed position (FIG. 2) to the stowed position (FIG. 3) to accommodate loads too large to be adequately supported by the deck alone. When the bail arm is in a stowed position, preferably it does not extend above a planar surface 31 of the deck 12, and more preferably, a bail arm surface 75 is below or flush with a planar surface 31 of the deck 12 as shown in FIG. 3. In one preferred form of the invention, the bail arm is biased toward the stowed position to prevent inadvertent deployment of the bail arm during use or storage of the pallet. To this end, a channel 32 is provided in the deck to receive a portion of the bail arm, and preferably has a sufficient depth so that when the bail arm is in the stowed position it is below the planar surface 31 of the deck or a surface of the bail arm is flush therewith.

In one preferred form of the invention, the channel 32 will be dimensioned to match the shape and size of the bail arm for proper stowage. FIG. 2 shows a generally U-shaped channel, when viewed from above, has two segments 34 horizontally spaced from one another in parallel spaced relationship. A third segment 36 extends transversely to the two segments 34 and connects proximal ends of the two segments.

The channel 32 is also generally U-shaped in cross-sectional dimension having two horizontally spaced side walls connected together at a proximal end by a bottom wall leaving a distal end open to provide access to a chamber for receiving a leg of the bail arm 30.

The first two segments 34 of channel 32 will each have a stowing channel 37 and a deploy channel 39 continuous with one another and divided by a pivot 50. While the two segments 34 are shown extending along a length dimension of the pallet, or parallel to the lateral edges 16, they could also be oriented to extend parallel to an end edge 18. Likewise, the third segment is shown extending in a line parallel to the end edge 18, it could be oriented to extend along a line parallel to the lateral edges 16 of the pallet.

Figure 9:
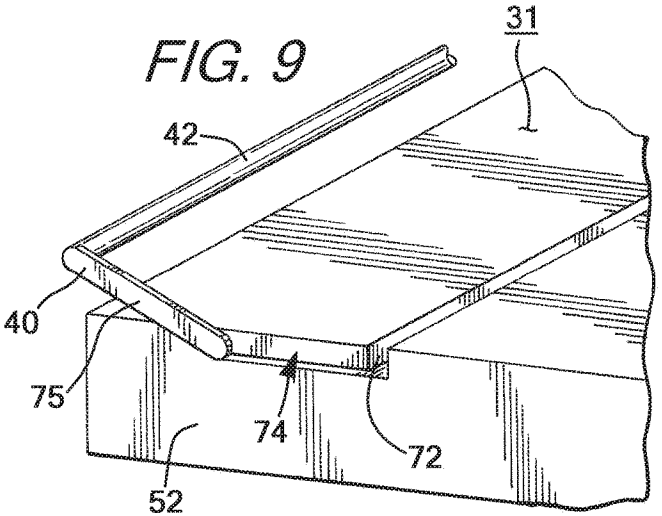
FIG. 9 is an isometric top view of an alternate embodiment of the present invention.

The bail arm assembly 30 includes two legs 40 horizontally spaced from one another in parallel spaced relationship and are connected together at their distal ends by a cross member 42. Each of the legs 40 is pivotally mounted to the pallet and preferably is connected by a pivot point 50. The pivot point 50 is positioned in the channel 34 as shown in FIGS. 2, 3, 6 and 7 or on a sidewall surface 52 as shown in FIG. 9. The pivot point can include, for example, a protuberance or protuberances extending from a surface of the channel or the bail arm that cooperatively engages a surface of the other member and the bail arm can rotate about the protuberance. The pivot point can also include axle integral with the bail arm, integral with the channel sidewall, or a separate piece for pivoting about an axis of the axle. Other pivoting mechanisms could also be used without departing from the scope of the present invention.

Figure 4:
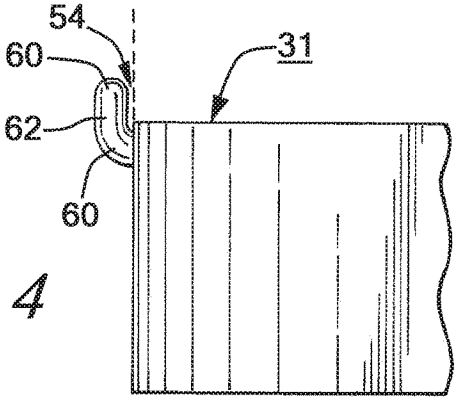
FIG. 4 is a side elevation view of a dolly or pallet with a bail arm of standard length in a deployed position.
Figure 5:
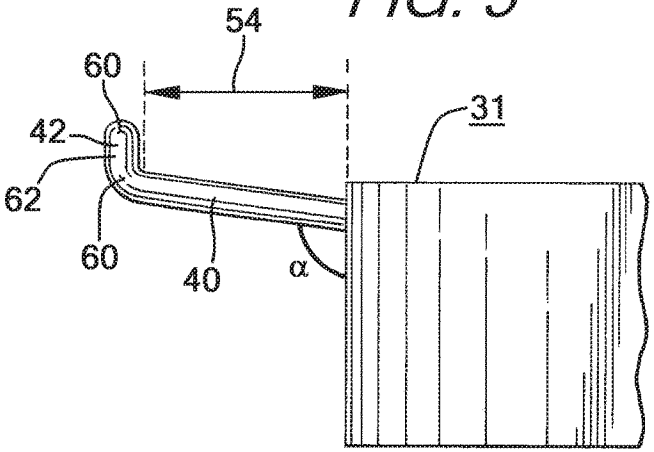
FIG. 5 is a side elevation view of a dolly or pallet with a bail arm of extended length in a deployed position.

As shown in FIG. 2, the two legs 40 have a length that is approximately the same length of the stowing channel 37, but longer than the deploy channel 39. The ratio of the length of the channel 34 to a leg 40 is from about 1:0.95 to about 1:0.55 or any range or combination of ranges therein. The difference between the lengths of the leg 40 and the deploy channel 37 defines an overhang dimension 54 (FIGS. 4 and 5). The overhang distance 54 when multiplied by a length dimension 56 (FIG. 8) of the cross member 42 (or the length of the adjacent peripheral edge 18 of the pallet) defines an overhang area. FIG. 5 shows that when the bail arm is in the deployed position, the leg 40 forms an angle $\alpha$ with the end edge 18. The angle $\alpha$ is preferably within the range of from about 75° to about 100° to the end edge 18.

In one preferred form of the invention, the cross member 42 is an assembly of parts such as a pair of connecting members 58, one of each connects opposed ends of the cross member 42 to the distal end of the legs 40. The connecting member 58 shown in FIGS. 2 and 8 have two elbow-shaped members 60 joined together by a cylindrical spacer 62 at a first end of each elbow member and the second ends of the elbow members point in directions roughly perpendicular to one another. As shown in FIG. 9, the connecting member is optional and the legs 40 can be directly connected to the cross member.

The bail arm 30 can also be a single integral piece. The bail arm can be fabricated from various materials such as plastics, metals, composites, and wood. The bail arm can be formed from any suitable processes such as, for metal pieces, metal forging, metal casting, metal cutting, metal extruding, and metal bending, for example. Plastic parts can be formed through thermoplastic or thermosetting shaping techniques including injection molding. Wood and composite materials can be molded or cut into the desired shape. The bail arm can also be formed using 3D printing techniques. Whether the bail arm is an assembly of parts or is a single integral piece, the term "bail arm assembly" is meant to encompass both.

Figure 8:
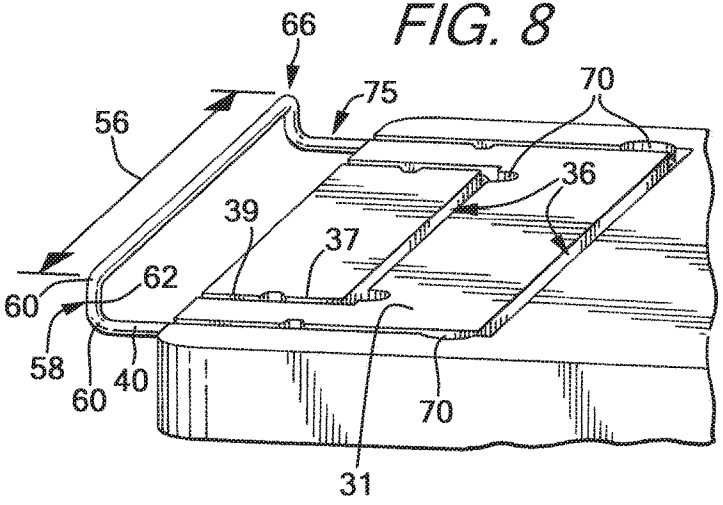
FIG. 8 is an isometric view of the dolly or pallet of FIG. 6 with a short bail arm in a stowed position and a long bail arm in a deployed position.
Figure 6:
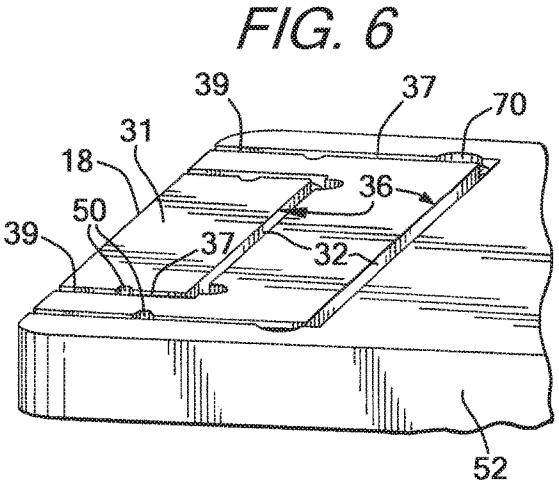
FIG. 6 is an isometric top view of another embodiment of a dolly or pallet of the present invention with two bail arms in a stowed position.
Figure 7:
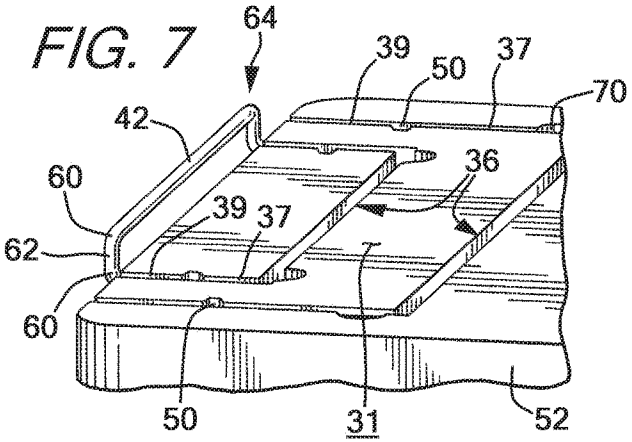
FIG. 7 is an isometric view of the dolly or pallet of FIG. 6 with a short bail arm in a deployed position and a long bail arm in a stowed position.

FIGS. 6-8 show another embodiment of the present invention including two separate mechanisms for increasing the support area of the pallet. The two separate support mechanisms can be independently deployed to form four conditions: both support mechanisms stowed, a first support mechanism deployed and a second support mechanism stowed; a first support mechanism stowed and a second support mechanism deployed; and both support mechanisms deployed. The first and second support mechanisms can be deployed in any combination of being associated with the same peripheral edge, being associated with different peripheral edges that are parallel, being associated with different peripheral edges that extend generally perpendicular. For a pallet having a square or rectangular shape, the pallet can have from 1 to 8 assemblies connected thereto.

In one exemplary form, the two bail arm assemblies are positioned proximal a single peripheral edge, the end edge 18. More particularly, the two bail arm assemblies include a short bail arm 64 nested within a long bail arm 66. FIG. 6 shows both bail arm assemblies in a stowed position. FIG. 7 shows the short bail arm 64 in a deployed position and the long bail arm 66 in the stowed position. FIG. 8 shows the long bail arm 66 in a deployed position and the short bail arm 64 in the stowed position. The generally U-shaped channel 32 has enlarged portions 70 to accommodate the connecting member 58 when in the stowed position.

FIG. 9 shows an alternative form of the present invention with a linear channel 72 connecting the opposed lateral edges of the deck. The linear channel 72 accommodates the cross member 42 when in the stowed position. Legs 40 are pivotally connected to the outer surface 52 of a sidewall of the pallet. In one form of the invention, a cut out 74 is provided so that an outer surface 75 of the leg 40 is flush with the sidewall outer surface 52. The arms 40, in this embodiment, are generally flat and are connected directly at a distal end to the cross member 42.

While the bail arms shown are generally semi-rectangular in shape, they could be of other shapes without departing from the scope of the present invention. For example, the bail arm could be generally semi-elliptical, semi-circular, semi-polygonal, or other shape.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

We claim:

1. A pallet comprising:

a deck having a generally planar upper surface having a peripheral edge defining a first area, and a ground engaging structure connected to the deck;

a first generally U-shaped channel in the deck having a first segment and a second segment extending in a direction generally perpendicular to the peripheral edge and horizontally spaced from one another, and a third segment extending in a direction transverse to the first segment and the second segment and connecting them, the first segment and the second segment each having a stowed portion and a deployed portion contiguous and collinear with one another;

a bail arm connected to the pallet is moveable from a stowed position in the stowed portion to a deployed position in the deployed portion where the bail arm extends beyond the peripheral edge to define an overhang area adjacent the first area to increase a total support area of the pallet.

2. The pallet of claim 1 when in the stowed position the bail arm is below the upper surface of the deck.

3. The pallet of claim 1 when in the stowed position a surface of the bail arm is flush with the upper surface.

4. The pallet of claim 1 wherein the bail arm comprises a first pair of two horizontally spaced legs and a cross member connecting the two legs.

5. The pallet of claim 4 wherein the cross member has a bar having opposed ends and a connecting member at each end for connecting to the legs.

6. The pallet of claim 1 wherein the bail arm is pivotally connected to the pallet.

7. The pallet of claim 1 wherein the first segment and the second segment extend from the peripheral edge and have a first length.

8. The pallet of claim 7 wherein each of the legs has a second length, the ratio of the first length to the second length is from 1:0.95 to 1:0.55.

9. The pallet of claim 8 wherein the first segment and the second segment each has a pivot point about which the bail arm rotates.

10. The pallet of claim 9 wherein the pivot point is positioned in the U-shaped channel.

11. The pallet of claim 1 wherein the bail arm is a single, integral piece.

12. The pallet of claim 1 wherein the bail arm forms an angle from about 75° to about 100° with the peripheral edge.

13. The pallet of claim 1 further comprising a second bail arm connected to the pallet and is moveable from a stowed position to a deployed position.

14. The pallet of claim 13 wherein the second bail arm has a second pair of horizontally spaced legs extending parallel to the first pair of horizontal legs.

15. The pallet of claim 13 wherein the second bail arm extends parallel to the first bail arm.

16. The pallet of claim 15 wherein the second bail arm extends perpendicular to the first bail arm.

17. The pallet of claim 1 wherein the peripheral edge includes opposed lateral edges further comprising a second channel in the deck extending between the opposed lateral edges.

18. The pallet of claim 17 wherein the bail arm has a cross member that is received in the second channel when in a stowed position.

19. The pallet of claim 18 wherein the bail arm further comprises a pair of legs one of each extending from opposed ends of the cross member and transverse thereto.

20. The pallet of claim 19 wherein each of the pair of legs is pivotally connected to a side edge of the deck.

21. The pallet of claim 1 wherein the ground engaging structure comprises a plurality of feet.

22. The pallet of claim 1 wherein the ground engaging structure comprises a wheel.

23. The pallet of claim 1 wherein the ground engaging structure comprises a plurality of wheels.

* * * * *